United States Patent [19]

Yamada

[11] Patent Number: 4,748,432

[45] Date of Patent: May 31, 1988

[54] DEVICE FOR THE AUTOMATIC CONTROL OF ROOM TEMPERATURE IN EXISTING AUTOMOBILES

[76] Inventor: Kiyoshi Yamada, 403, 3-2-21, Kishinosato, Nishinari-ku, Osaka, Japan

[21] Appl. No.: 905,457

[22] Filed: Sep. 10, 1986

[51] Int. Cl.[4] ..... H01H 37/66

[52] U.S. Cl. ..... 337/366; 236/48 R; 337/373

[58] Field of Search ..... 236/48 A, 101 D; 337/366, 373, 349, 356, 359

[56] References Cited

U.S. PATENT DOCUMENTS

| | | | |
|---|---|---|---|
| 1,867,756 | 7/1932 | Penn | 337/373 X |
| 2,068,270 | 1/1937 | Hulse | 337/366 |
| 2,149,853 | 3/1939 | McCabe | 337/373 X |
| 2,596,366 | 5/1952 | Brockett | 236/48 A |
| 2,702,844 | 2/1955 | Kronmiller | 337/366 X |
| 3,190,988 | 6/1965 | Graham et al. | 337/366 X |
| 3,211,864 | 10/1965 | Larsen | 337/366 |

*Primary Examiner*—William E. Tapoicai

*Attorney, Agent, or Firm*—Wenderoth, Lind & Ponack

[57] ABSTRACT

A device for the control of room temperature in existing automobiles is placed in series with the driving circuit of the blower motor of the automobile. The temperature control device includes a bimetal or spiral bimetallic strip capable of setting a working temperature. The bimetal is used for the direct detection of the room temperature of the automobile. An insulating member is attached to a free end of the bimetal. The insulating member carries a first electrical contact, and a mating contact opposes the first contact. Respective lead wires are attached to each contact. A switch lever rotates the bimetal to set a desired temperature. A stopper is provided to hold the contacts together so that, regardless of the ambient temperature, the blower motor remains on, and the user can rely solely on the existing controls.

1 Claim, 3 Drawing Sheets

DEVICE FOR THE AUTOMATIC CONTROL OF ROOM TEMPERATURE IN EXISTING AUTOMOBILES

BACKGROUND OF THE INVENTION

1. Field of the Invention

This invention concerns a method of and a device for the automatic control of room temperature in existing automobiles that can be mounted easily to existing automobiles irrespective of type, and can always maintain the room temperature automatically at a comfortable level.

2. Description of the Prior Art

Heretofore, most automobiles have no automatic control devices for regulating the room temperature, and power control switches of blower motors have usually been switched manually to adjust the flow rate of the blower motors by the use of flow rate control resistors. As the space in the chamber of an automobile is narrow and tightly closed, temperature changes therein are too rapid to be properly compensated for by the conventional manual operation, thereby often rendering the room temperature undesirably high and making the driver sleepy or undesirably low and irritating. Further, as the manual control is often operated mainly by the driver, he or she is obliged to look aside or hold the steering wheel by one hand during this manual control, thus failing to concentrate attention on the car driving, which may lead to accidents.

SUMMARY OF THE INVENTION

An object of this invention is to overcome the foregoing drawbacks in the control of the room temperature by the conventional manual operation. Means is provided that can be attached easily to all types of existent automobiles and is not affected by differences in the voltage and electrical current required for heaters and coolers of various automobiles.

Another object of this invention is to maintain the room temperature automatically always at a comfortable level, thereby keeping the room temperature from becoming undesirably high and making the driver sleepy, or undesirably low and irritating, as well as ensuring safe operation by freeing the driver from looking aside or having to hold the handle in one hand during driving. In this manner, car accidents which have been frequently experienced so far in such cases, are prevented.

The foregoing objects of this invention can be attained by using spiral bimetals, securing the center of the bimetals to a supporting shaft, supporting the shaft on a substrate so as to be rotatable by a lever dependent on the desired setting of the temperature. Also, respective lead wires are connected to a contact appended to the top end of the bimetals and from a mating contact disposed on the substrate. The wires are connected to the driving circuit for a blower motor in an existing automobile in series with the blower motor, thereby adapting the contact at the top end of the bimetals to be brought into contact with or separated from the mating contact when the room temperature goes higher than the setting temperature and turn the driving circuit for the blower motor to "ON" for supplying cold air from a cooler to the inside of a room. Alternatively, the user may turn the driving circuit to "OFF", thereby interrupting the supply of warmed air from a heater to the inside of the chamber, by adapting, conversely, the contact at the top end of the bimetals to be separated from or brought into contact with the mating contact when the room temperature goes lower than the setting temperature and turn the driving circuit for the blower motor to "OFF", thereby interrupting the supply of the cold air from the cooler to the inside of the room, or turn the driving circuit to "ON" thereby supplying the warmed air from the heater to the inside of the room, thus always keeping the room temperature automatically at a predetermined comfortable level.

BRIEF DESCRIPTION OF THE DRAWINGS

The appended drawings show preferred embodiments according to this invention, wherein.

DESCRIPTION OF PREFERRED EMBODIMENTS

This invention has accomplished the foregoing objects and will now be described more specifically, referring to the appended drawings illustrating the preferred embodiments thereof.

Figure 1:
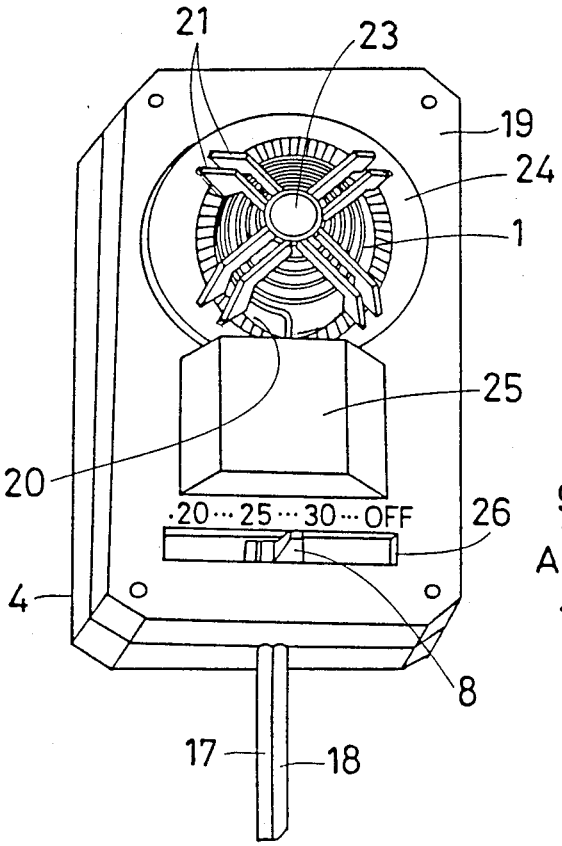
FIG. 1 is a perspective view of the entire device.
Figure 2:
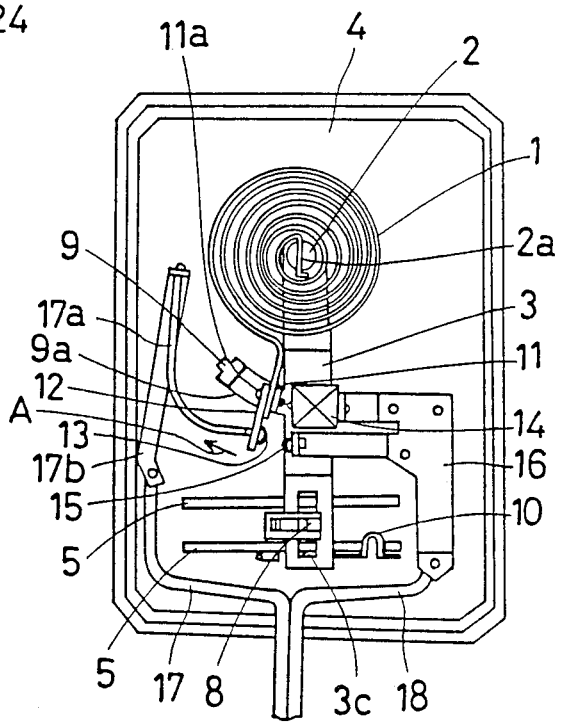
FIG. 2 is a plan view of one embodiment for maintaining the room temperature constant upon warming shown with the cover removed.
Figure 3:
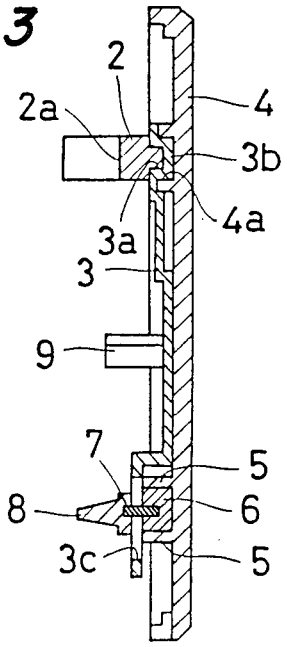
FIG. 3 is a longitudinal cross sectional view at the center of a portion in FIG. 2 showing the inserted state of the lever to the substrate with the bimetallic strip removed for clarity.
Figure 4:
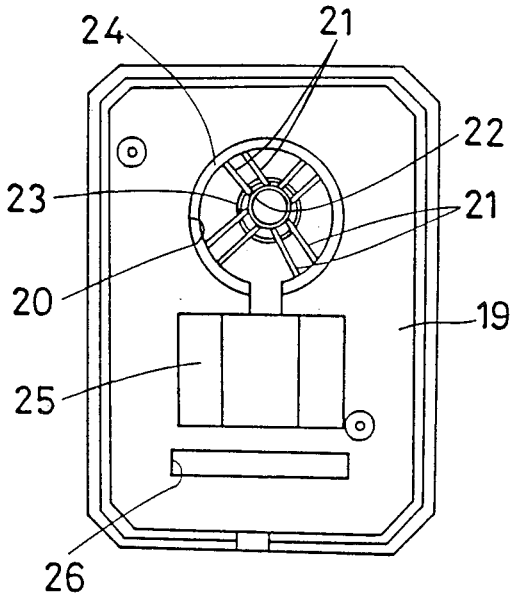
FIG. 4 is a rear view for the cover.
Figure 5:
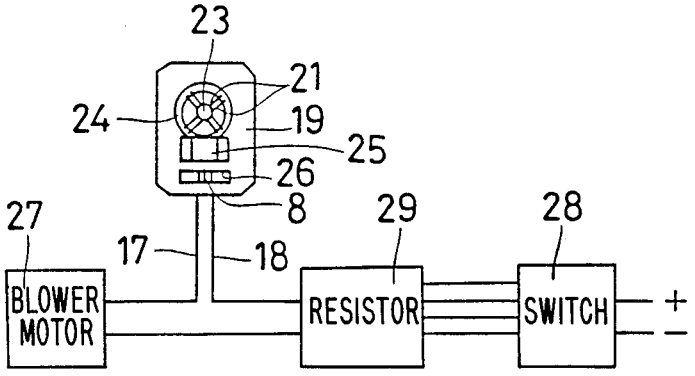
FIG. 5 is a block diagram illustrating the connection of the device according to this invention to an existent automobile.

Spiral bimetals or bimetallic strips 1 are shaped by spirally forming a bimetal member from the center counterclockwise, and the center of which is inserted and secured to a slot 2*a* formed at the upper end of a support shaft 2. A lever 3 made of plastic is perforated at the upper surface of the base or pivotably attached end thereof with a recess 3*a* for inserting the lower end of the support shaft 2, and the lower end of the shaft 2 is inserted into and fixed to the recess 3*a*. As shown in FIG. 3, the lever 3 is provided at the lower surface of the base end thereof with a protrusion 3*b*, which is rotatably inserted into a recess 4*a* perforated in a substrate 4 made of plastics. Ridges 5, 5 protrude from the lower portion of the substrate 4 in parallel with the bottom side and a slider 6 is slidably inserted between the ridges 5 and 5. An operation rod 7 secured to the slider 6 protrudes from an elongate hole 3*c* in the top or free end of the lever 3 covering the ridges 5 and 5 as shown in FIG. 3 and inserted and fixed to the protrusion to form a knob 8. The knob 8 is so adapted that the top end of the lever 3 is swung to rotate the protrusion 3*b* at the lower surface of the base end within the recess 4*a* of the substrate 4 depending on the setting temperature, thereby rotating the spiral bimetal 1 in accordance with the temperature setting. A retainer 9, for the top end of the bimetals 1, may optionally be disposed at the top end of an arcuate portion 9*a*, which is attached to the middle portion of the lever 3 as shown in FIG. 3. When the top or free end of the lever 3 is caused to slide toward the rightward end of the ridges 5 and 5, the retainer 9 urges the top end of the bimetals 1 rightwardly thereby bringing a contact 13 and a mating contact 15 as described below into contact with each other. In this manner, lead wires 17 and 18 provide the same effect as if the device according to this invention was not disposed in the driving circuit for a blower motor 27 as shown in FIG. 5. Thus, the bimetals 1 are effectively cut out of the circuit, thereby enabling the usual manual operation using a power control switch 28 and a flow rate control resistor 29. A stopper 10 has a top end which protrudes inwardly through a recess formed in the rightmost end of the lower ridge 5 and which projects between the ridges 5 and 5; stopper 10 has a base portion (unnumbered) made of a resilient material secured to the outside of the lower ridge 5. When the top or free end of the lever 3 is moved rightwardly, the stopper 10 secures the slider 6 in the position where the top end of the bimetals 1 is secured by the retainer 9 (OFF). An iron piece 11, secured to the top end of the bimetals 1 on the side facing the rotating direction of the top end of the bimetals 1, rotates along with the lowering of the temperature (the direction opposite to the arrow A in FIG. 2). An insulation plate 12 is secured at the top end face of the bimetals 1 on the side opposite to the iron piece 11 by means of a clamping member 11*a* used in common with the iron piece 11. The contact 13 is attached to the top end of the insulation plate 12 in the same direction as the iron piece 11. A magnet 14 and a mating contact 15 are opposed to the iron piece 11 and the contact 13 respectively and secured by a mounting plate 16 so as to be situated above the lever 3. The magnet 14 attracts the iron piece 11 to maintain the electrical contact stably between the contact 13 and the mating contact 15. A lead wire 17 from the contact 13 comprises a flexible conductor wire 17*a*, which is wired between the contact 13 and a fixing member 17*b* so as to allow the contact 13 to move, extends from the fixing member 17*b*. A lead wire 18 from the mating contact 15 extends from one end of the mounting plate 16 for securing the mating contact 15. A cover 19 made of plastics is engaged to the upper surface of the substrate 4 for covering the surface. A window 20 is provided at an upper portion for accomodating the upper surface of the spiral bimetals 1. Brackets 21 are radially formed to span the periphery of the window 20, and a window cover 24 supporting a central plate 23, perforated with an upper end engaging hole 22 for engaging the upper end of the support shaft 2, is secured to the center at the upper surface of the window 20. An upper protrusion 25 is formed at the central portion of the cover 19 for accommodating the magnet 14, and the like, protruding above the substrate 4. A window 26 is provided in the lower portion of the cover 19 for allowing knob 8 therethrough, and the window is disposed in parallel with the ridges 5 and 5 on the substrate 4 and, as shown in FIG. 1, a setting temperature indicia (°C.) corresponding to the operation of the spiral bimetals 1 is provided thereon. The temperatures increase from the left side and an (OFF) is made at the lower right side end on the upper surface thereof. A blower motor 27 for the existent automobile comprises a driving circuit connected, as is known, from a power source by wiring the power control switch 28 and the flow rate control resistor 29. As shown in FIG. 5, the driving circuit is connected with the lead wires 17 and 18 in series with the blower motor 28 by the device according to this invention.

When the top end of the lever 3 is properly set to a comfortable temperature by the operation of the knob 8, if the room temperature is lower than the temperature thus set, the contact 13 and the mating contact 15 at the top end of the bimetals 1 are brought into contact which each other and turn the driving circuit for the blower motor 27 to "ON", thereby starting the blower motor 27 and supplying heated warmed air from the warming heater to the inside of the room. When the room temperature rises by the supply of the warmed air higher than the set temperature as described above, the top end of the bimetals 1 displaces in the direction of the arrow A in FIG. 2, by which the contact 13 at the top end of the bimetal 1 and the mating contact 15 are separated from each other and turn the driving circuit for the blower motor 27 to "OFF", thereby interrupting the blower motor 27 and stopping the supply of warmed air from the warming heater to the inside of the room. Then, as the room temperature drops and it again falls lower than the set temperature, the same operations as described above are repeated, so that the room temperature can always be controlled automatically at a certain comfortable level.

Figure 6:
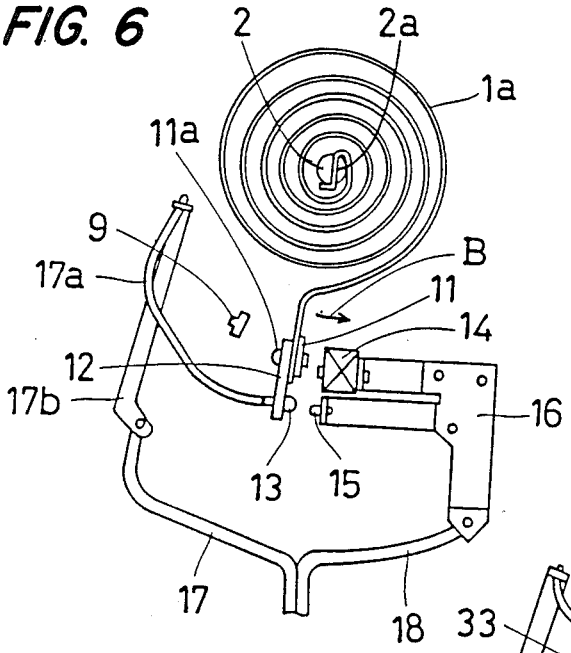
FIG. 6 is a plan view for a portion showing the constitution of a second embodiment in which the spiral bimetals are turned upside down for controlling the room temperature constant upon cooling.

FIG. 6 shows the second embodiment of this invention for controlling the room temperature constant during cooling operation, in which the spiral bimetal 1 in the foregoing first embodiment are inverted to form reversed spiral bimetals 1*a* and the positions of the iron piece 11 and insulation plate 12 relative to the top end face of the bimetals 1 are reversed. Lead wires 17 and 18 are connected to the driving circuit for the blower motor 27 in the same manner as in the previous embodiment.

When the top end of the lever 3 is rotated by the shifting of the knob 8 to set an appropriate comfortable temperature and if the room temperature is higher than the set temperature, the top end of the reversed spiral bimetals 1*a* displaces in the direction of the arrow B in FIG. 6, by which the contact 13 and the mating contact 15 are brought into contact to turn the driving circuit for the blower motor 27 to "ON" thereby supplying the cold air chilled by the cooler to the inside of the room by the blower motor 27. Thus, when the room temperature descends to lower than the set temperature, the top end of the bimetals 1*a* displaces in the direction opposite to the arrow B in FIG. 6, by which the contact 13 and the mating contact 15 are separated from each other and turn the driving circuit for the blower motor 27 to "OFF", thereby stopping the blower motor 27 and interrupting the supply of cold air from the cooler to the inside of the room. Then, when the room temperature rises higher than the set temperature, the same operations as described above are repeated to thereby always control the room temperature automatically at a constant comfortable level.

Figure 7:
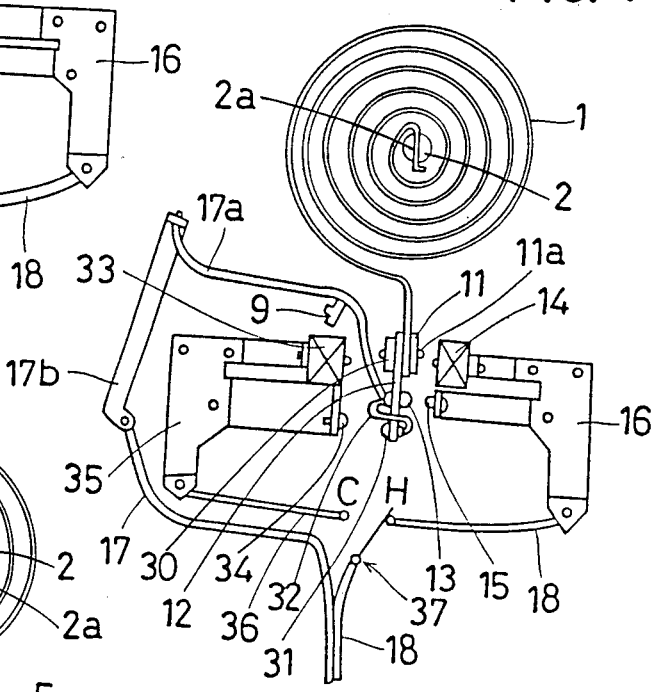
FIG. 7 is a plan view for a portion showing the constitution of a third embodiment used both for warming and cooling in which the room temperature is controlled constant.

FIG. 7 shows the third embodiment according to this invention used both for warming and cooling and for keeping the room temperature constant. An iron piece 30, similar to the iron piece 11 in the first embodiment, is secured to the top end of the bimetals. Iron piece 30 is located on the surface of the insulation plate 12 on the side opposite to that of the iron piece 11 of the spiral bimetals 1 in the first embodiment, together with the iron piece 11 and the insulation plate 12, by means of a clamping member 11*a*; a contact 31 similar to the contact 13 is appended to the extended top end of the insulation plate 12 on the same side as the iron piece 30. The contacts 13 and 31 are wired with a conductor wire 32; a magnet 33 and a mating contact 34 are secured to the mounting plate 35 in a manner similar to the mounting plate 16 such that they are situated above the lever 3 and opposed to the iron piece 30 and the contact 31. A switch 37 for switching the warming and cooling is disposed between the lead wire 36 from the mating contact 34 and the lead wire 18 from the contact 15. The lead wires 17 and 18 are connected to the driving circuit for the blower motor 27 in the same manner as in the foregoing embodiment.

Upon using this embodiment, when the switch 37 for switching the warming and cooling is switched to the side H on the lead wire 18 for warming, the same state as in the first embodiment (FIG. 2) is established. In this case, if the contact 31 and the mating contact 34 are brought into contact, as the switch 37 situates on the side H, the driving circuit for the blower motor 27 does not turn to "ON". When the switch 37 is switched to the side C on the lead wire 36 upon cooling, the same state as in the second embodiment (FIG. 6) is attained. Also, in this case, if the contact 13 and the mating contact 15 are brought into contact, as the switch 37 is turned to the side C, the driving circuit for the blower motor 27 does not turn to "ON".

Figure 8:
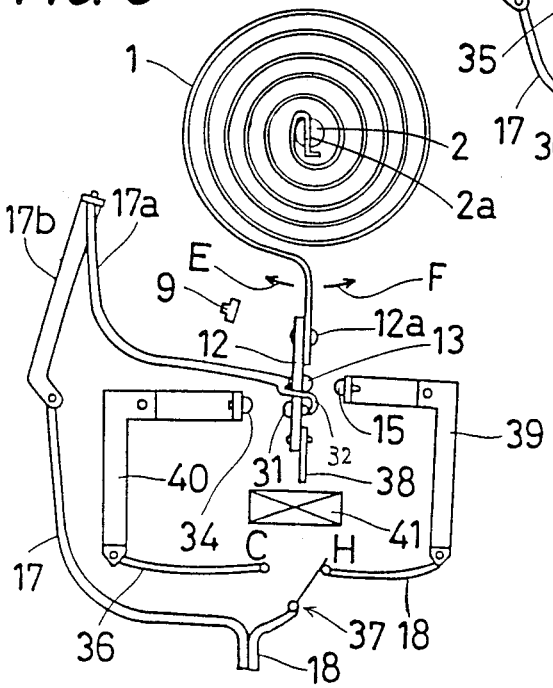
FIG. 8 is a plan view for a portion showing the constitution of a fourth embodiment used both for warming and cooling in which the room temperature is controlled constant.

FIG. 8 shows the fourth embodiment according to this invention used both for the warming and cooling and for keeping the room temperature constant. The same spiral bimetals 1 as in the first embodiment and the third embodiment are used, and an insulation plate 12 longer than that in the third embodiment is secured to the top end of the bimetals 1 by means of a clamping member 12*a*. An iron piece 38 is secured to the top end of the plate 12. Contacts 13 and 31, connected to each other by means of a conductor wire 32, are appended on both sides of the intermediate portion as in the third embodiment (FIG. 7), while mating contacts 15 and 34 are secured to mounting plates 39 and 40 similar to the mounting plates 16 and 35 respectively, so that they are situated above the lever 3 and opposed to the contacts 13 and 31. A switch 37 for switching warming and cooling is put between the lead wire 18 from the mating contact 15. The lead wire 36 from the mating contact 35 and a magnet 41 having magnetic poles vertical to the iron piece 38 is secured toward the top end of the iron piece 38. The lead wires 17 and 28 are wired to the driving circuit of the blower motor 27 in the same manner as in the previous embodiment.

Upon using this embodiment, the switch 37 for switching the warming and cooling is switched to the side H on the lead wire 18 upon warming. The lever 3 is operated by the knob 8 to set an appropriate temperature. If the room temperature is lower than the set temperature, the top end of the bimetals 1 displaces in the direction of the arrow F in FIG. 8, by which the contact 13 and the mating contact 15 are brought into contact and turn the driving circuit for the blower motor 27 to "ON", thereby supplying the warmed air from the heater. As the iron piece 38 is brought nearer to the magnetic pole at the right end of the magnet 41, the iron piece 38 is attracted to the magnetic pole and stabilizes the contact between the contact 13 and the mating contact 15. Then, when the room temperature goes higher than the set temperature owing to the supply of warmed air, the top end of the bimetals 1 displaces in the direction of the arrow E in FIG. 8, by which the contact 13 and the mating contact 15 are separated from each other and turn the driving circuit for the blower motor 27 to "OFF", thereby interrupting the supply of warmed air and lowering the room temperature.

Further, the switch 37 for switching the warming and the cooling is switched to the side C on the side of the lead wire 36 upon cooling, and the lever 3 is manipulated by the knob 8 to set an appropriate temperature. If the room temperature is higher than the set temperature, the top end of the bimetals 1 displaces in the direction of the arrow E in FIG. 8, so that the contact 31 and the mating contact 34 are brought into contact with each other; the iron piece 38 situates near the magnetic pole at the left end of the magnet 41 to stabilize the contact, by which the driving circuit for the blower motor 27 is turned "ON", thereby supplying cold air from the cooler to the inside of the room to cool the chamber.

Then, when the room is cooled and the room temperature is lowered to less than the set temperature, the top end of the bimetals 1 displaces in the direction of the arrow F in FIG. 8, by which the contact 31 and the mating contact 34 are separated from each other and turn the driving circuit for the blower motor 27 to "OFF", thereby supplying cold air from the cooler to the inside of the room. Then, the room temperature again rises to repeat the same operations as described above, whereby the room temperature can always be controlled automatically at a certain set temperature.

In this case, if the contact 31 and the mating contact 34 are brought into contact upon warming and the contact 13 or the contact 13 and the mating contact 15 are brought into contact upon cooling, the driving circuit for the blower motor 27 does not turn "ON" as described above for the third embodiment.

As has been described above, this invention utilizing spiral bimetals 1 can be manufactured at a reduced cost and can be installed with ease in existing and newly manufactured automobiles. Further, the room temperature can always be maintained automatically at a moderate temperature by mounting the device according to this invention, thereby keeping the room temperature from rising or lowering excessively, which would make a driver sleepy or irritated.

Furthermore, as the room temperature can be controlled automatically according to this invention, the manual control is no longer necessary, thereby allowing the driver to concentrate only on driving, thus ensuring safe driving.

Furthermore, as the driving circuit for the blower motor 27 is turned "ON" or "OFF" by the bimetals 1 according to this invention, it is readily adaptable to all types of automobiles regardless of effects such as differences in the voltage and in the electrical current required for the heater and the cooler. Furthermore, given the top end retainer 9 for the respective bimetals 1, 1*a* disposed according to this invention, by causing the lever 3 to slide, by the operation of the knob 8, to the OFF position such as shown in FIG. 1, the top end of the respective bimetals 1, 1*a* is urged by the top end retainer 9 appended to the middle portion of the lever 3, thereby keeping the contact 13 and the mating contact 15 in forced contact. Thus, the lead wires 17 and 18 for the contact 13 and the mating contact 15 are conducting, whereby manual control by the power control switch 28 and the flow rate control resistor 25 is also possible as in the usual manner. However, in the case of the third embodiment and the fourth embodiment, it is necessary that the switch 37 for switching the warming and cooling be previously switched to the side H.

What is claimed is:

1. A device for controlling the room temperature of an existing automobile comprising:

a base plate having a support shaft means at one end thereof;

a lever rotatably supported at one end thereof on said support shaft means, said lever extending toward the other end of said base plate, and terminating in a free end;

a temperature-responsive spiral bimetal means supported on the rotatably supported end of said lever; said spiral bimetal means including a spiral portion and a free end, said free end having an insulating plate attached thereto;

an iron piece attached to said insulating plate;

a magnet attached to said base plate in spaced opposed relation to said iron piece;

a contact attached to said insulating plate, said contact being spaced from said free end of said bimetal means and from said iron piece;

a mating contact attached to said base plate in spaced opposed relation to said contact on said insulating plate;

a lead wire means for each said contact and said mating contact for connecting said device in series with a blower motor of an existing automobile;

a knob means attached to said free end of said lever for rotating said lever and said bimetal means therewith; and a stopper means for releasably retaining said knob means at a position in which said contact and mating contact contact each other regardless of the ambient temperature acting on said spiral bimetal means.

* * * * *